United States Patent [19]

Vosswinkel

[11] Patent Number: 4,582,449

[45] Date of Patent: Apr. 15, 1986

[54] MANHOLE SEALING DEVICE

[75] Inventor: Gilbert Vosswinkel, Milwaukee, Wis.

[73] Assignee: City of Milwaukee, Milwaukee, Wis.

[21] Appl. No.: 450,540

[22] Filed: Dec. 17, 1982

[51] Int. Cl.[4] ..... E02D 29/14

[52] U.S. Cl. ..... 404/25; 52/20; 264/32

[58] Field of Search ..... 404/25, 26, 72; 52/19, 52/20, 21; 264/35, 32; 285/370, 379, DIG. 16

[56] References Cited

U.S. PATENT DOCUMENTS

| | | | |
|---|---|---|---|
| 3,387,864 | 6/1968 | Walters | 285/DIG. 16 |
| 4,049,296 | 9/1977 | Harrison | 285/379 |
| 4,261,541 | 4/1981 | Morrow | 264/32 |
| 4,305,679 | 12/1981 | Modi | 404/25 |
| 4,469,467 | 9/1984 | Odill et al. | 404/25 |

FOREIGN PATENT DOCUMENTS

| | | | |
|---|---|---|---|
| 1078580 | 11/1954 | France | 285/DIG. 16 |
| 39953 | 3/1977 | Japan | 264/32 |
| 48117 | 4/1977 | Japan | 52/744 |
| 1087178 | 10/1967 | United Kingdom | 52/20 |

*Primary Examiner*—Stephen J. Novosad
*Assistant Examiner*—Michael Goodwin
*Attorney, Agent, or Firm*—Michael, Best & Freidrich

[57] ABSTRACT

A manhole sealing device and method for sealing a frame-chimney joint between a manhole chimney and a manhole cover frame. The device comprises an annular ring defining a narrow annular space adjacent the frame and the chimney and across the frame-chimney joint, and a flexible water resistant cement filling the annular space and adhering to the annular ring, the frame and the chimney. In one embodiment of the invention, the ring is comprised of a plurality of segments. The ring segments are held together by slip joints and the ring includes an expansion joint to permit the adjustment of the annular space. The annular ring further includes a plurality of horizontal retainers secured in the frame-chimney joint for securing the ring adjacent the frame and the chimmey.

16 Claims, 3 Drawing Figures

MANHOLE SEALING DEVICE

BACKGROUND OF THE INVENTION

This invention relates to a device and method for sealing manholes, and, more particularly, to a device and method for sealing the inside of a manhole to prevent water infiltration through a frame-chimney joint.

Modi U.S. Pat. No. 4,305,679, issued Dec. 15, 1981, discloses a manhole sealing device comprising a flexible tube-like membrane spanning a frame-chimney joint which is held in place by a plurality of hubs pressing the membrane radially outwardly against a manhole chimney and cover frame. The use of a prefabricated membrane makes the Modi device more costly than the device disclosed herein.

SUMMARY OF THE INVENTION

This invention provides a manhole sealing device for sealing a frame-chimney joint between a manhole chimney and a manhole cover frame. The device comprises a ring which spans the frame-chimney joint and defines a narrow annular space adjacent the frame and the chimney. The annular space is filled with a flexible water resistant cement which adheres to the ring, the frame and the chimney.

The invention can also be described as a device comprising ring means for spanning the frame-chimney joint, and adhering means for adhering the ring means to the manhole chimney and the manhole cover frame. The adhering means provides a water tight seal between the ring means and the manhole chimney and the ring means and the manhole cover frame.

In one embodiment of the invention, the ring and the ring means comprises an annular ring, and the ring is comprised of a plurality of segments. The ring segments are held together by slip joints and the ring includes an expansion joint to permit the adjustment of the annular space. The annular ring further includes a plurality of horizontal retainers secured in the frame-chimney joint for securing the ring adjacent the frame and the chimney.

One of the principal features of this invention is the provision of a simple inexpensive means for sealing a manhole frame-chimney joint. Current methods require the use of expensive prefabricated membrances. This invention alleviates the need for a prefabricated membrane entirely.

Other features and advantages of embodiments of the invention will become apparent upon reviewing the following drawings, the detailed description and the appended claims.

Figure 1:
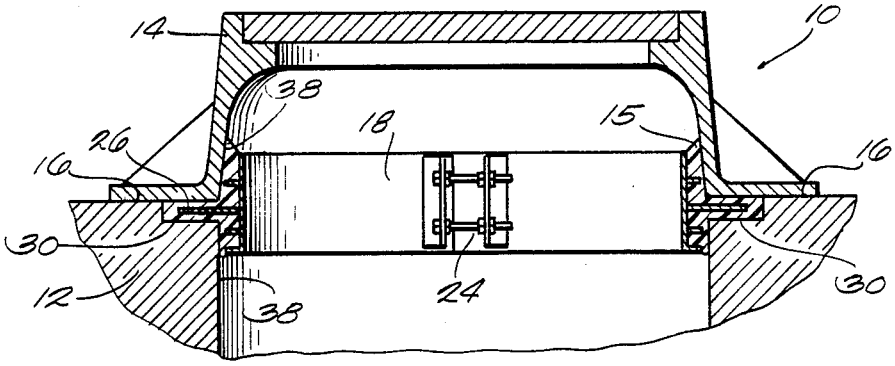
FIG. 1 is a cross sectional view of a manhole sealing device embodying various features of the invention.

Before explaining at least one embodiment of the invention in detail, it is to be understood that the invention is not limited in its application to the details of construction and the arrangement of the components set forth in the following description or illustrated in the drawings. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

As illustrated in the drawings, the invention provides a manhole sealing device 10 for use with a manhole chimney 12 and a manhole cover frame 14. The device 10 seals the frame-chimney joint 16 between the manhole chimney 12 and cover frame 14 against water infiltration through the frame-chimney joint 16.

In one embodiment, the device 10 comprises a ring 18 and a water resistant cement 32 which adheres the ring 18 to the chimney 12 and cover frame 18. The ring 18 spans the frame-chimney joint 16, and defines a narrow annular space 15 adjacent the frame 14 and the chimney 12 and can be made from 18-guage sheet metal. Heavier guages can be used for large diameter chimneys. The annular ring 18 is comprised of three ring segments 20 joined together by slip joints 22 and one expansion joint 24. The slip joints 22 facilitate the easy assembling of the ring 18 and the expansion joint 24 permits the adjusting of the ring's diameter to adjust the size of the annular space 15.

The annular ring 18 further includes a plurality of horizontal retainers 26 projecting from the ring's outer periphery 28 for securing the ring adjacent the frame 14 and the chimney 12. The retainers 26 are secured in the frame-chimney joint 16 between the base of the manhole cover frame 14 and the top of the manhole chimney 12.

Old manholes will frequently have had deterioration occur around the top of the manhole. This deterioration will provide space in the frame-chimney joint 16 for the retainers 26. Chimneys which have not deteriorated will need to have a space 30 cut from the top of the manhole chimney 12 to provide room for the horizontal retainers 26.

The flexible water resistant cement 32 fills the annular space 15 between the annular ring 18, frame 14 and chimney 12 and adheres to the annular ring 18, frame 14 and chimney 12. The water resistant material 32 can be a bituminous plastic cement meeting federal specification SS-C-153C, which is incorporated herein by reference, or any other suitable cement for connecting together the annular ring 18, chimney 12 and and frame 14 and for preventing water filtration through the frame-chimney joint 16.

Because of the severe temperature changes which can occur with the changing seasons, the material 32 must be flexible enough to withstand expansions and contractions resulting from temperature and structural changes at the frame-chimney joint. Examples of commercial products suitable for this material 32 are Coal Cat 850, as manufactured by Pittsburg Paint Company and Sealtite Sewer Joint Compound, as manufactured by W. R. Meadows, Inc.

Horizontal spacers 34 extend radially outwardly from the periphery 28 of the annular ring 18 to assist in positioning the annular ring 18 in the manhole chimney 12 to achieve the appropriately narrow annular space 15, as hereinafter described, and to help secure the cement 32 to the ring 18.

A primer 36 appropriate for use with the flexible, water-resistant cement is applied to the periphery 28 of the annular ring and the inner surfaces 38 of the manhole cover frame 14 and the manhole chimney 12 to insure that the water resistant cement 32 adheres to the ring 18, frame 14 and chimney 12 and prevents any water from finding a path through the frame-chimney joint 16.

The lower edge of the annular ring 18 includes an outwardly extending dam 40 narrower than the annular space 15 to help insure the water resistant cement 32 stays between the annular ring 18, chimney 12 and cover frame 14.

In this embodiment, the annular ring 18 is installed in the manhole in the following manner. The manhole cover frame 14 is first cleaned of all loose rust and foreign materials. The walls in the manhole are then reshaped if significant deterioration has occurred. Restoration of the deterioration may necessitate the chipping away of brick or block on one side of the manhole while possibly building up the other side of the manhole. Any other loose and deteriorating material should also be replaced. Any repair work can be accomplished with the use of a fast-setting, non-shrink mortar. A slot or space 30 approximately one inch wide and deep enough to receive the horizontal retainers 26 on the ring is then made in the top of the chimney 12 directly below the manhole frame 14.

Special care should be taken to see that the contact area of the frame 14, slot 30 and chimney 12 adjacent the annular ring 18 is clean and clear of all loose material. These surfaces 38 and the outside periphery 28 of the annular ring 18 are then primed.

Figure 2:
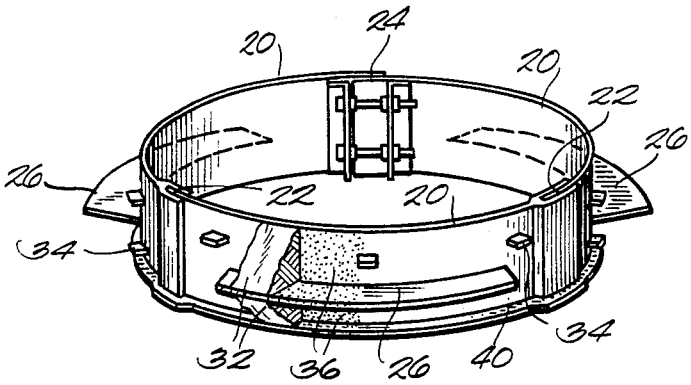
FIG. 2 is a perspective view partially broken away of the device's annular ring with a primer and a flexible water resistant cement applied to the annular ring.
Figure 3:
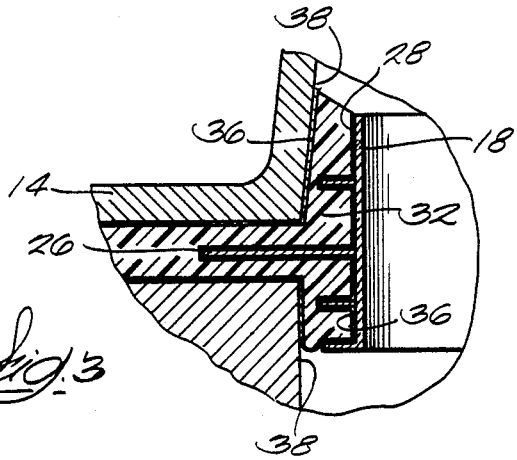
FIG. 3 is an enlarged view of a corner of the device shown in FIG. 1.

When the primer 36 is dry, the water resistant cement 32 is then applied to each ring segment 20 of the annular ring 18 prior to placing the segment 20 in the manhole chimney 12. Enough cement 32 should be used to insure proper sealing. In this embodiment, enough cement 32 is used to form a 45° angle between the horizontal retainers 26 and the tops and bottoms of the annular ring 18, as illustrated in FIG. 2. Each segment 20 is then placed around the manhole chimney 12 until the full annular ring 18 is assembled.

Additional water resistant cement 32 can be forced into the annular space 15 between the annular ring 18, the chimney 12 and frame 14, if needed, until the space 15 is totally filed. The expansion joint 24 can then be adjusted to insure than the annular space 15 is wide enough to allow enough water resistant cement 32 between the ring 18, chimney 12 and cover frame 14 to seal the frame-chimney joint 16, but narrow enough so as to require no more cement material 32 than necessary.

Depending on field conditions encountered, the installation of the ring 18 can take from 15 minutes to approximately 3 hours or longer.

The segmental ring 18 can be maufactured in any size depending on the configuration of the frame and the chimney to be sealed.

Various of the features of the invention are set forth in the following claims.

I claim:

1. A manhole sealing device for sealing a frame-chimney joint between a manhole chimney and a manhole cover frame, said device comprising means spanning said frame-chimney joint and defining a narrow annular space adjacent the frame and the chimney and across the frame-chimney joint, said means defining an annular space adjacent the frame and the chimney comprising an annular ring including a plurality of segments, and a flexible, water resistant cement filling said annular space and adhering to said space defining means, the frame, and the chimney.

2. A manhole sealing device according to claim 1 wherein said ring segments are held together by slip joints.

3. A manhole sealing device according to claim 1 wherein said annular ring includes an expansion joint to permit the adjustment of said annular space.

4. A manhole sealing device according to claim 1 wherein said annular ring further includes means for securing said ring adjacent the frame and the chimney, said means comprising a plurality of horizontal retainers located in the frame-chimney joint.

5. A manhole sealing device according to claim 1 and further including means for holding said flexible, water resistant cement in place.

6. A manhole sealing device in accordance with claim 1 wherein said means defining a narrow annular space adjacent the frame and the chimney and across the frame-chimney joint defines said annular space adjacent the inside of the frame and the chimney.

7. A manhole sealing device for sealing a frame-chimney joint between a manhole chimney and a manhole cover frame, said device comprising means spanning the frame-chimney joint and defining a narrow annular space adjacent the frame and the chimney and across the frame-chimney joint, said space defining means comprising an annular ring with a lower edge, a flexible, water resistant cement filling said annular space and adhering to said space defining means, the frame and the chimney, and means for holding said flexible, water resistant cement in place, said holding means comprising a dam extending radially outwardly from said lower edge of said annular ring.

8. A manhole sealing device according to claim 7 wherein said annular ring further includes means for securing said ring adjacent the frame and the chimney, said means comprising a plurality of horizontal retainers located in the frame-chimney joint.

9. A manhole sealing device according to claim 7 and further including means for holding said flexible water resistant cement in place.

10. A manhole sealing device in accordance with claim 7 wherein said means defining a narrow annular space adjacent the frame and the chimney and across the frame-chimney joint defines said annular space adjacent the inside of the frame and the chimney.

11. A manhole sealing device for sealing a frame-chimney joint between a manhole chimney and a manhole cover frame, said device comprising an annular ring spanning the frame-chimney joint and including a plurality of segments, and adhering means located between said ring and the manhole chimney and between said ring and the manhole cover frame for adhering said ring to the manhole chimney and the manhole cover frame, said adhering means providing a water tight seal between said ring and the manhole chimney and said ring and the manhole cover frame.

12. A manhole sealing device according to claim 11 wherein said ring segments are held together by slip joints.

13. A manhole sealing device according to claim 11 wherein said annular ring includes an expansion joint to permit the adjustment of the diameter of said ring.

14. A manhole sealing device according to claim 11 wherein said annular ring further includes means for securing said ring adjacent the frame and the chimney, said means comprising a plurality of horizontal retainers located in the frame-chimney joint.

15. A manhole sealing device according to claim 11 wherein said adhering means comprises a flexible water resistant cement.

16. A manhole sealing device in accordance with claim 11 wherein said ring spanning the frame-chimney joint spans the frame-chimney joint on the inside of the manhole chimney and the manhole cover frame.

* * * * *